US005248420A

United States Patent [19]

Calmes et al.

[11] Patent Number: 5,248,420

[45] Date of Patent: Sep. 28, 1993

[54] APPARATUS FOR DEWATERING SLAG SAND

[75] Inventors: Marc Calmes, Luxembourg; Radomir Andonov, Mamer; Emile Lonardi, Bascharge, all of Luxembourg

[73] Assignee: Paul Wurth S.A., Luxembourg, Luxembourg

[21] Appl. No.: 905,063

[22] Filed: Jun. 24, 1992

Related U.S. Application Data

[63] Continuation of Ser. No. 628,699, Dec. 14, 1990, abandoned.

[30] Foreign Application Priority Data

Jan. 15, 1990 [LU] Luxembourg ..... 87-657

[51] Int. Cl.[5] ..... B01D 21/00

[52] U.S. Cl. ..... 210/256; 210/260; 210/261; 210/262; 210/311; 210/513

[58] Field of Search ..... 210/299-301, 210/311, 521, 522, 540, 256, 259-262, 513

[56] References Cited

U.S. PATENT DOCUMENTS

| | | | |
|---|---|---|---|
| 563,864 | 7/1896 | Meloney | 210/311 |
| 2,325,257 | 7/1943 | Loker | 210/311 |
| 3,938,434 | 2/1976 | Cox | 210/225 |
| 4,238,333 | 12/1980 | Tidwell | 210/540 |

FOREIGN PATENT DOCUMENTS

| | | | |
|---|---|---|---|
| 179482 | 8/1905 | Fed. Rep. of Germany | 210/311 |

*Primary Examiner*—Ivars Cintins
*Attorney, Agent, or Firm*—Fishman, Dionne & Cantor

[57] ABSTRACT

Provided below the funnel-shaped outlet opening of a receptacle filled with wet slag sand is an outlet funnel which is closed to begin with and forms a conical annular gap around the receptacle. This gap fills with slag sand, as a result of which dewatering occurs according to the principle of the siphon effect.

16 Claims, 3 Drawing Sheets

APPARATUS FOR DEWATERING SLAG SAND

This is a of copending application Ser. No. 07/628,699 filed on Dec. 14, 1990, now abandoned.

TECHNICAL FIELD

The invention relates to an apparatus for dewatering slag sand, in particular blast furnace slag sand located in a receptacle.

BACKGROUND OF THE INVENTION

In the prior art, the slag flowing out of a shaft furnace, e.g. a blast furnace, is quenched by means of water jets emerging from nozzles in such a way that the liquid slag turns into a more or less fine slag sand. So that this slag sand can be used further in a profitable manner, the mixture of slag sand and water known as the slag mash, which results from the said spraying must as far as possible be dewatered.

According to the prior art, this dewatering takes place without exception by wall sections of a receptacle for the wet slag sand being designed as filtering surfaces permeable to water. To this end, the vertical side walls, for example of a cylindrical receptacle, can be designed entirely or partly as filter surfaces, or even only the conical outlet area of such a receptacle.

In the first case, the filtering surfaces can be designed to be relatively large, but the portion of slag sand located in the bottom, e.g. conical, outlet is left without being dewatered; whereas in the second case, dewatering of this portion certainly takes place, but the filtering surface remains relatively small. In both cases, but especially in the last mentioned case, the filter surfaces are exposed to high mechanical compressive stress from the contents of the receptacle so that these filter wall sections must be of appropriately resistant, that is expensive, construction.

A particularly serious disadvantage of both constructions (or a combination of the two) consists in the fact that the said filter surfaces become clogged by slag sludge after relatively short use and thus become ineffective. To remove the sludge from the filter surfaces, injection of water, for example by means of nozzles, from outside through the filter surfaces toward the interior of the receptacle is known in the prior art.

SUMMARY OF THE PRESENT INVENTION

To avoid these disadvantages of the prior art, it is therefore the object of the invention to propose an apparatus of the generic category mentioned at the beginning for dewatering slag sand, which apparatus does not need any filter surfaces while maintaining a maximum dewatering effect.

This object is achieved by an apparatus which is characterized in that the bottom outlet opening of the receptacle leads into an outlet funnel which is arranged downstream of the receptacle and whose diameter in the area of the said bottom outlet opening is greater than the diameter of this outlet opening of the receptacle that a free, annular passage for rising extracted water flowing off over the said top edge is formed between the said outlet opening and the said top edge.

BRIEF DESCRIPTION OF THE DRAWINGS

Exemplary embodiments of the invention are shown in the drawings and will be described in greater detail below.

In the drawings.

DETAILED DESCRIPTION OF THE INVENTION

Figure 1:
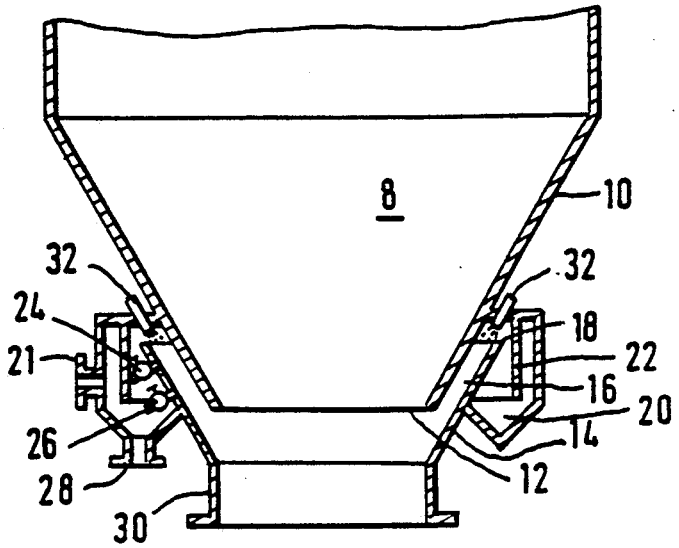
FIG. 1 shows a schematic longitudinal section through a first exemplary embodiment of the invention having an essentially conical outlet funnel.

FIG. 1 shows the bottom part of a, for example cylindrical, receptacle 8 for the slag sand to be dewatered, having a preferably conical bottom outlet 10 (the slag sand charge of the receptacle 8 is not shown further in the FIGURE). The outlet opening 12 of the outlet 10 is surrounded by an outlet funnel 14 arranged downstream, likewise of an essentially conical shape. The diameters of the outlet 10 in its bottom part and of the outlet funnel 14 are appropriately selected in order to create between the two a conical annular gap 16, the top edge 18 of the outlet funnel 14 being higher than the bottom edge of the outlet opening 12.

The functional principle of the apparatus according to the invention is based on the principle of communicating vessels. On the basis of this principle, the water contained in the slag sand rises in the annular channel 16 and runs off in a first stage of the dewatering over the top edge 18 of the outlet funnel 14. On account of its density and internal friction, the slag sand portion of the slag mash does not participate in this rising of the water in the annular space 16, which results in the separation between sand and water, and with astonishing efficiency, as tests have shown. Accordingly, the slag sand itself acts as a filter mass.

In said first stage of the dewatering, the water is allowed to flow of over the top edge 18, since a good separating action between water and any entrained sludgy sand constituents takes place over the relatively large distance thereby provided between outlet 12 and this top edge 18, in particular because substantial slowing-down of the water velocity takes place when the water rises in the widening annular gap 16.

The water flowing over the edge 18 is caught in an encircling annular space 20 and drawn off via a discharge 21.

For the purpose of further providing the separating effect between water and entrained slag sludge, a separating and steadying wall 22 having an additional separator action can facultatively be provided in the annular space 20, in which case accumulating sludge can settle in the bottom part of the annular space 20 and, after dewatering is complete, can be drawn off through a discharge 28.

It has been found in said tests that, in the further course of dewatering, the cleanliness of the accumulating water increases on account of the increasing filtering effect of the slag sand drying in the receptacle 8, and the accumulating water quantities naturally decrease. The invention therefore facultatively makes provision for the water, as water purity increases and water quantity decreases, to be allowed to flow off, first of all through a valve 24 and later through a valve 26 in an even lower position, as a result of which the dewatering process is shortened. During the dewatering operation, the flow of slag sand is blocked by the cylindrical runoff connection piece 30, e.g. by means of a squeezing valve (not shown) which is known per se and is attached below the connection piece 30 in the adjoining discharge pipe (not shown).

Finally, the invention facultatively provides water injection nozzles 32 in any number which are arranged all around at the top part of the annular space 20 and serve to clean the outlet funnel 14 if the receptacle 8 is completely emptied at any time between two dewatering operations.

Figure 2:
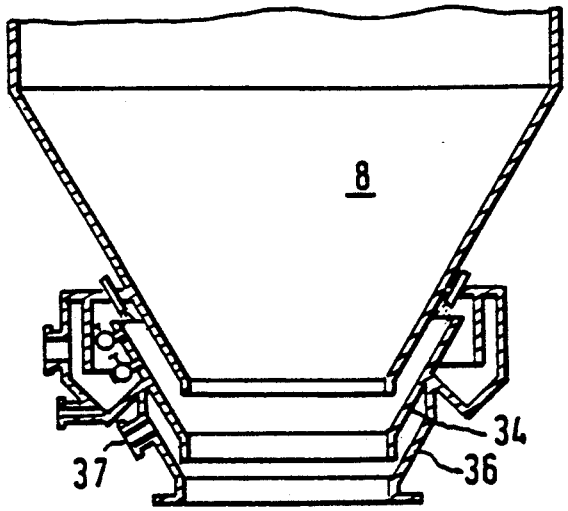
FIG. 2 shows a schematic longitudinal section through a second exemplary embodiment of the invention similar to that in FIG. 1 but having a double outlet funnel in tandem arrangement.

FIG. 2 shows an embodiment variant of the invention in which two outlet funnels 34, 36 connected one behind the other in tandem arrangement are provided. In this way, not only is the intended separating effect according to the invention between slag sand and water improved even further, but the portions of slag sand otherwise not participating in the separation operation, e.g. in FIG. 1, the quantities of slag sand located below the outlet opening 12, are also reduced to a minimum. The bottom funnel 36 is used for this purpose by opening its water outlet 37 when the top funnel 34 has performed its function.

Figure 3:
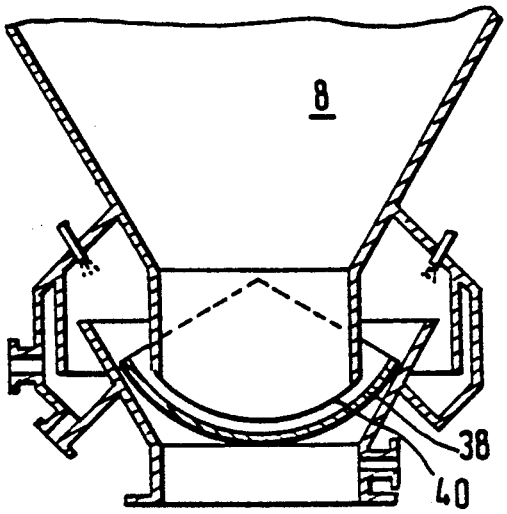
FIG. 3 shows a schematic longitudinal section through a third exemplary embodiment similar to that in FIG. 1 but additionally having a pivotable shutter for the receptacle outlet.

FIG. 3 shows a constructional example having a pivotal shutter 38 at the outlet 40 of the receptacle 8. The squeezing valve (not shown) is relieved of the weight of the receptacle charge by this shutter 38. But the shutter also helps to reduce to a minimum the bottom quantity of slag sand already reduced with the arrangement according to FIG. 2 and not dewatered.

Figure 4:
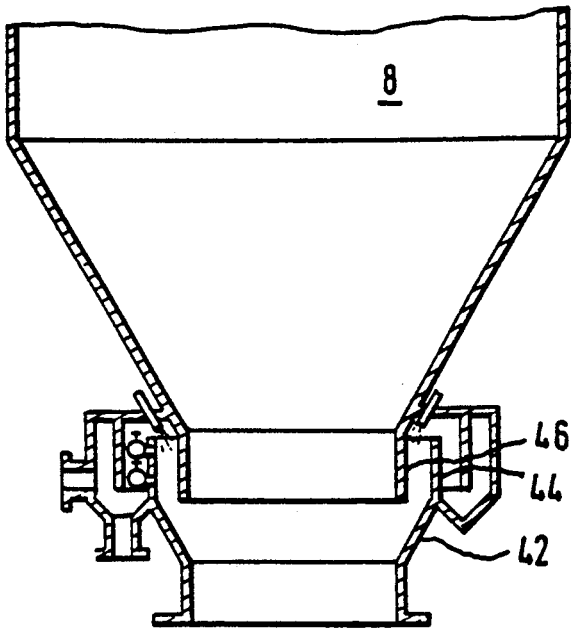
FIG. 4 shows a schematic longitudinal section through a fourth exemplary embodiment of the invention having a cylindrical-conical profile of of the outlet funnel.

FIG. 4 shows a construction in which an outlet funnel 42 according to the invention is not designed so as to run continuously in a conical manner to the top, e.g. in FIG. 1, but its top part 44 has essentially cylindrical forms. To make this possible, the outlet of the receptacle 8 has a corresponding cylindrical connection piece 46. This configuration ensures that small quantities of slag sand cannot possibly be floated off to the top along a continuously sloping funnel wall (see 14 in FIG. 1) but are retained in the bottom part of the funnel 42 on account of their density.

Figure 5:
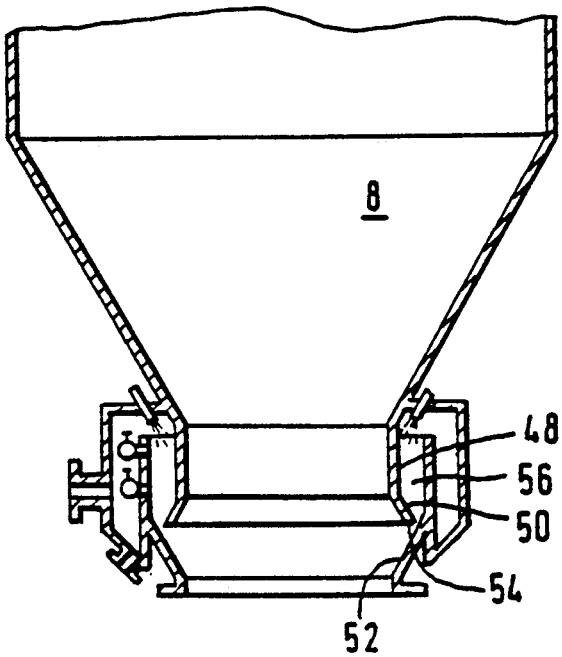
FIG. 5 shows a schematic longitudinal section through a fifth exemplary embodiment of the invention similar to that in FIG. 4 but having a conical widening of the receptacle outlet.

In FIG. 5, in an extended construction of FIG. 4, an outlet connection piece 48 of the receptacle 8 is provided at the bottom with a conical skirt 50 widening toward the bottom. This configuration creates a relatively narrow annular gap 54 between the skirt 50 and the outlet funnel 52, with the effect that not only is slag sand restrained in a purely mechanical manner from floating up, but in addition a further separation effect also results due to the water-velocity gradient in the gap 54 and the annular space 56 located above it.

Figure 6:
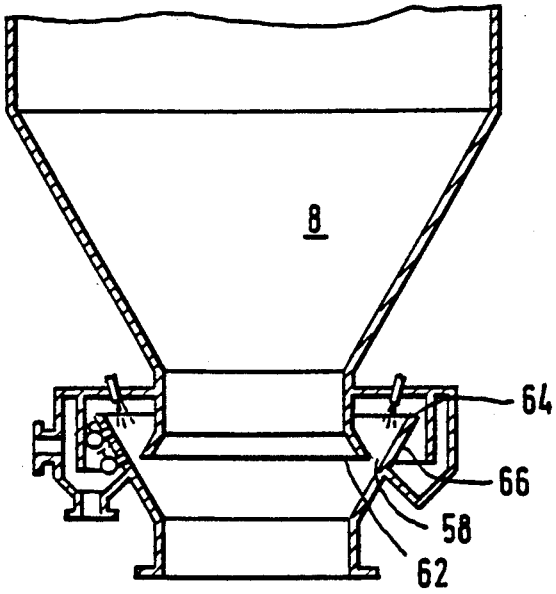
FIG. 6 shows a schematic longitudinal section through a sixth exemplary embodiment of the invention, essentially consisting of a combination of the exemplary embodiments according to FIGS. 1 and 5.

The construction according to FIG. 6 puts into concrete form an extension of the idea of the separation effect by means of water-velocity gradient in the annular gap 58, widening to the top, between the outlet skirt 62 of the receptacle 8 and the funnel wall 66, which is again of conical design. Due to the considerable cross sectional increase in this annular gap 58 and the deceleration in the water velocity accompanying this reduction, the said separation effect is substantially assisted by decantation.

Figure 7:
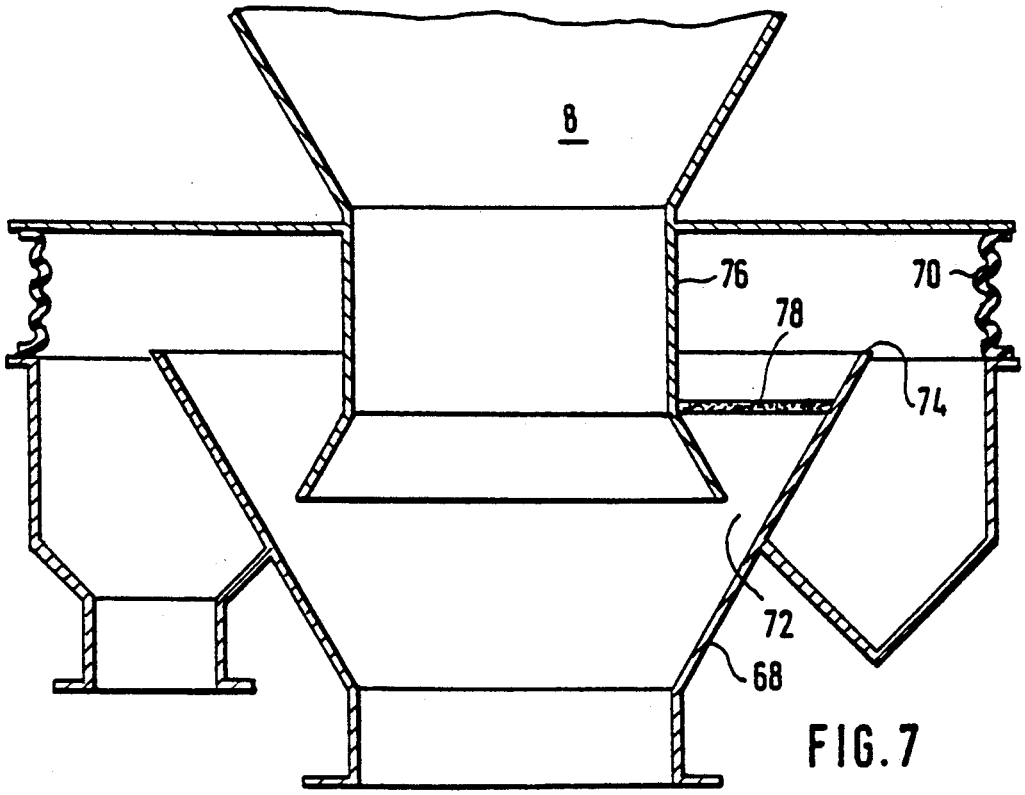
FIG. 7 shows a schematic longitudinal section through a sixth exemplary embodiment of the invention having a vertically adjustable outlet funnel.

FIG. 7 shows an extension of the inventive alternative shown in FIG. 6 by the outlet funnel 68 according to the invention being designed to be vertically adjustable with accessories. Encircling bellows 70 permit a corresponding vertical moment of the sytem, this vertical displacement being brought about with the aid of means (not shown) known per se.

If the funnel 68 is displaced upwards, the gap 72 narrows while at the same time the water volume located above it increases and the end edge 74 is lifted higher, which as follows from the above explanations, results in optimum cleaning effects. This vertical adjustment enables the apparatus to be optimally adapted to various grades of sand.

For the purpose of further optimizing the cleaning effect, the invention facultatively provides an annular encircling filter element 78 between the outlet connection piece 76 of the receptacle 8 and the outlet funnel 68. In contrast to the filter elements mentioned at the beginning according to the prior art, this filter element 78, which preferably acts as a retaining screen, is not exposed to any great mechanical stress together with corresponding wear and in particular does not have to bear the weight of the receptacle contents.

While preferred embodiments have been shown and described, various modifications and substitutions may be made thereto without departing from the spirit and scope of the invention. Accordingly, it is to be understood that the present invention has been described by way of illustrations and not limitations.

What is claimed is:

1. An apparatus for dewatering slag sand, comprising:

receptacle means for containing the slag sand to be dewatered, said receptacle means having a bottom edge defining a bottom outlet opening of a first diameter;

first funnel means for receiving slag sand and water discharged from the bottom outlet opening of the receptacle means, said first funnel means having a top edge defining an inlet opening of a second diameter, said second diameter being greater than said first diameter, and said top edge of said first funnel means being disposed above the bottom edge of the receptacle means so that a free annular inlet section is formed between said bottom edge of the receptacle means and said first funnel means, said free annular inlet section opening in an annular passage between said receptacle means and said first funnel means, for rising extracted water, cleaning the extracted water from the slag sand by decantation and allowing the water to flow off over said top edge, said annular passage having at least an inlet portion extending upwardly from said inlet section with a widening free cross-section.

2. The apparatus of claim 1, wherein said first funnel means includes a side wall and wherein a plurality of valves are provided in said side wall at different heights below the top edge for a controlled drainage of said annular passage at different heights.

3. The apparatus of claim 2, further comprising annular receptacle means surrounding said top edge for receiving water overflowing the top edge and water drained through said valves.

4. The apparatus of claim 1, further comprising annular receptacle means surrounding said top edge for receiving the water overflowing the top edge.

5. The apparatus of claim 4, further comprising a vertically extending separator wall provided within the annular receptacle means.

6. The apparatus of claim 4, wherein the annular receptacle defines one or more discharge openings for draining water from the annular receptacle.

7. The apparatus of claim 1, further comprising nozzle means for cleaning the annular passage.

8. The apparatus of claim 1, wherein said funnel means has a bottom edge defining a funnel means outlet, said funnel means outlet having a third diameter, further comprising second funnel means for receiving slag sand and water from said first funnel means, said second funnel means having a top edge defining an inlet opening of a fourth diameter, said fourth diameter being greater than said third diameter, and said top edge of said second funnel means being disposed above said bottom edge of said first funnel means so that a second annular passage for allowing overflow of water separated from the slag sand is formed therebetween.

9. The apparatus of claim 1, further comprising pivotally mounted shutter means for opening and closing the bottom outlet opening of the dewatering receptacle means, said shutter means being disposed in said first funnel means directly below said bottom outlet opening of the receptacle means.

10. The apparatus of claim 1, wherein the dewatering receptacle means includes a frustoconical outlet portion diverging upwardly from the bottom edge of the receptacle means.

11. The apparatus of claim 1, wherein the dewatering receptacle means includes a cylindrical outlet portion extending vertically upwardly from the bottom edge of the receptacle means.

12. The apparatus of claim 1, wherein the dewatering receptacle means includes a cylindrical outlet portion and a frustoconical skirt portion diverging downwardly from the cylindrical outlet portion to the bottom edge of the receptacle means, in order to define said free annular inlet section and said inlet portion with said first funnel means.

13. The apparatus of claim 12, wherein the first funnel means include a cylindrical inlet portion extending vertically downwardly from the top edge of the first funnel means.

14. The apparatus of claim 1, wherein the first funnel means include a frustoconical inlet portion converging downwardly from the top edge of the first funnel means.

15. The apparatus of claim 14, wherein the first funnel means is vertically displaceable relative to the dewatering receptacle means.

16. The apparatus of claim 1, wherein said annular passage comprises an outlet portion extending upwardly from said inlet portion and having annular filter means therein.

* * * * *